United States Patent [19]

Cofer et al.

[11] 4,129,170

[45] Dec. 12, 1978

[54] APPARATUS FOR PRODUCING A HOT-FORMED PRODUCT

[75] Inventors: Daniel B. Cofer; George C. Ward; Dale D. Proctor, all of Carrollton, Ga.

[73] Assignee: Southwire Company, Carrollton, Ga.

[21] Appl. No.: 800,070

[22] Filed: May 24, 1977

Related U.S. Application Data

[60] Continuation of Ser. No. 323,471, Jan. 15, 1973, abandoned, which is a continuation of Ser. No. 816,127, Apr. 14, 1969, abandoned, which is a division of Ser. No. 390,666, Aug. 19, 1964, Pat. No. 3,317,994, which is a continuation of Ser. No. 613,245, Feb. 1, 1957, abandoned.

[51] Int. Cl.[2] ..... B22D 11/12

[52] U.S. Cl. ..... 164/270; 164/76; 164/442

[58] Field of Search ..... 164/76, 82, 87, 88, 164/270, 442, 448, 431, 433; 29/527.7, 33 C

[56] References Cited

U.S. PATENT DOCUMENTS

| | | | |
|---|---|---|---|
| 395,684 | 1/1889 | Baker | 164/76 |
| 406,946 | 7/1889 | Norton | 164/76 |
| 494,659 | 4/1893 | Very | 164/76 X |
| 770,130 | 9/1904 | Trotz | 29/33 C |
| 1,092,934 | 4/1914 | Mellen | 164/82 |
| 1,193,001 | 8/1916 | Edwards | 72/235 |
| 2,710,433 | 6/1955 | Properzi | 164/417 X |

OTHER PUBLICATIONS

*The Making, Shaping and Treating of Steel,* U.S. Steel, 1957, pp. 820–821.

*Primary Examiner*—Richard B. Lazarus
*Assistant Examiner*—Gus T. Hampilos
*Attorney, Agent, or Firm*—Wigman & Cohen

[57] ABSTRACT

What is disclosed herein is an apparatus for producing a hot-formed product from a cast metal without homogenizing of the cast metal between a casting means and a hot-forming means. The apparatus includes a conditioning means for reducing the cross-sectional area of the cast metal with a single compression by at least 36% as the cast metal passes at substantially hot-forming temperature between the casting means and the hot-forming means. The reduction of the cross-sectional area of the cast metal by at least 36% substantially destroys the as cast dendritic structure of the cast metal prior to the cast metal being hot-formed in the hot-forming means and results in hot-forming being achieved without the splitting and cracking of the cast metal which would otherwise occur in the absence of conventional homogenizing. The conditioning means is disclosed as being either a separate means positioned between the casting means and the hot-forming means or a part of the hot-forming means arranged to accomplish a reduction of at least 36% as the initial step in the hot-forming of the cast metal.

14 Claims, 6 Drawing Figures

Fig 1
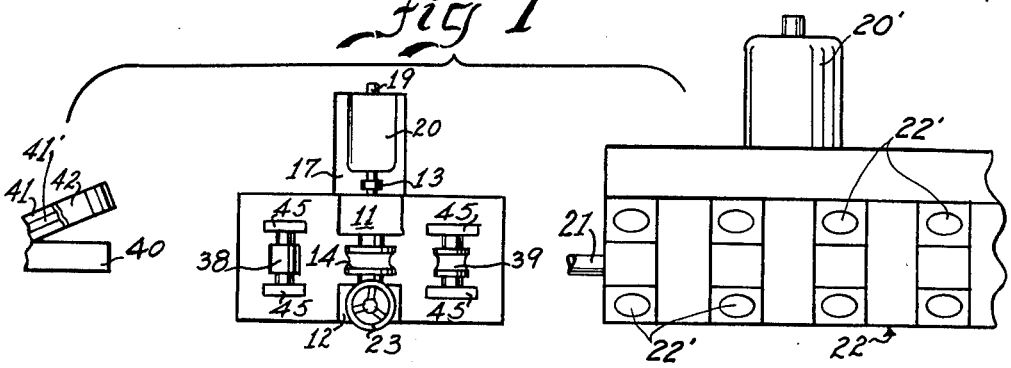
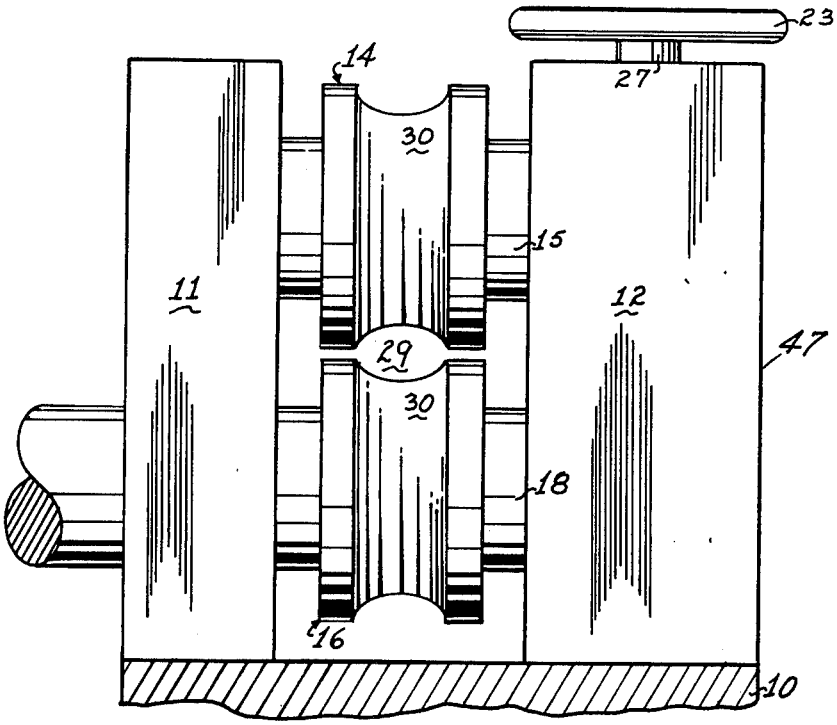
Fig 2
INVENTORS
DANIEL B. COFER
GEORGE C. WARD
DALE D. PROCTOR Fig 4
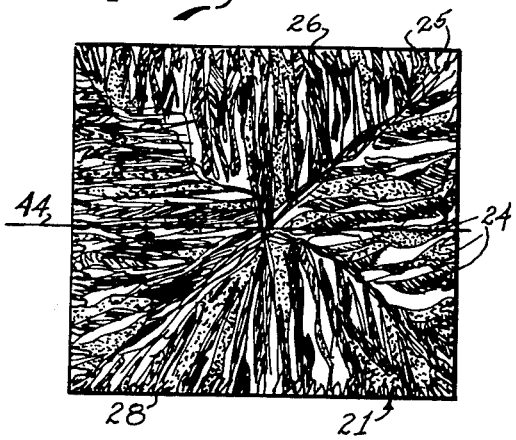
Fig 3
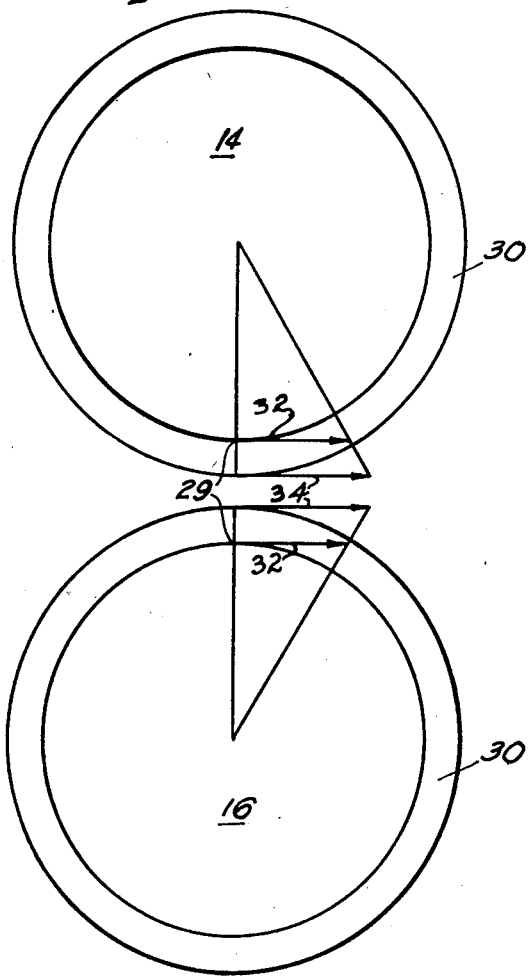
Fig 6
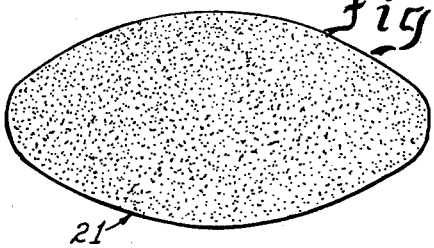
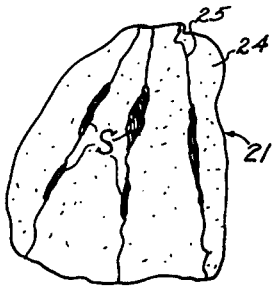
Fig 5
INVENTORS
DANIEL B. COFER
GEORGE C. WARD
DALE D. PROCTOR

APPARATUS FOR PRODUCING A HOT-FORMED PRODUCT

CROSS-REFERENCE TO RELATED APPLICATION

This application is a continuation of application Ser. No. 323,471, filed Jan. 15, 1973, now abandoned, which was a continuation of Ser. No. 816,127, filed Apr. 14, 1969, now abandoned, which was a division of Ser. No. 390,666, filed Aug. 19, 1964, now U.S. Pat. No. 3,317,994, which was a continuation of Ser. No. 613,245, filed Feb. 1, 1957, now abandoned.

BACKGROUND OF THE INVENTION

1. Field of the Invention

This invention relates generally to the hot-forming of metal and more particularly, to apparatus for producing a hot-formed product from a cast metal without homogenizing the cast metal prior to hot-forming.

2. Description of the Prior Art

In the hot-forming of a cast metal to produce a hot-formed product, cracking and splitting of the cast metal is frequently encountered as the result of a characteristic commonly known as hot shortness. Moreover, cast metal usually has internal stresses due to non-uniform cooling rates during casting or due to straightening the cast metal after casting. These stresses also cause cracking and splitting of the cast metal during hot-forming.

The cracking and splitting of a cast metal as the result of hot shortness or internal stresses can be avoided by homogenizing the cast metal prior to hot-forming. This is because homogenizing a cast metal disperses alloying and other elements and compounds from grain boundaries between dendrites within the cast metal into the dendrites. The result is an increase in tensile strength to a degree sufficient to resist cracking and splitting because of hot shortness or internal stresses.

The homogenizing of a cast metal requires that the cast metal be held at a temperature above the recrystallization temperature of the cast metal for an extended period of time. When the cast metal to be hot-formed is initially at room temperature, the elevated temperature and the period of time at this elevated temperature required for homogenizing the cast metal are obtained simply by reheating the cast metal to hot-forming temperature since this provides time and temperature conditions sufficient for homogenization. When the cast metal to be hot-formed has not been allowed to cool to room temperature from its casting temperature, the elevated temperature and the period of time at this elevated temperature required for homogenization of the cast metal can be obtained only by holding the cast metal at approximately casting temperature for an extended period of time. This is commonly known as soaking. Thus, whether a cast metal to be hot-formed is at room temperature or at casting temperature prior to hot-forming, homogenization of the cast metal prior to hot-forming is time consuming and frequently requires extensive equipment and space.

Moreover, neither of the above techniques for homogenizing a cast metal is suited to the continuous casting and hot-forming of a cast metal since it is impractical to cool and reheat a cast metal as it is being continuously cast and hot-formed so as to provide for homogenizing of the cast metal before it is fed to the hot-forming means and since it is impractical to hold a cast metal as it is being continuously cast at an elevated temperature for the length of time required to accomplish homogenization of the cast metal while it is being continuously fed from a casting means to a hot-forming means. Thus, the homogenization of a cast metal prior to hot-forming is a generally unsatisfactory method of preventing splitting and cracking of the cast metal during hot-forming and is a particularly unsatisfactory method of accomplishing this objective where it is desired to continuously hot form a continuously cast metal.

SUMMARY OF THE INVENTION

The invention disclosed herein substantially eliminates these and other problems associated with producing of a hot-formed product from a cast metal in that it provides apparatus in which a cast metal is hot-formed without any significant tendency to crack or split even though the cast metal has not been homogenized and even though the cast metal would crack or split during hot-forming in prior art apparatus. This is because apparatus embodying the invention includes a conditioning means which serves to condition a cast metal for hot-forming by reducing the cross-sectional area of the cast metal in a single compression without substantial splitting and cracking and to that extent necessary to destroy the columnar dendritic structure in the cast metal.

The apparatus also includes a casting means and a hot-forming means and the conditioning means is positioned between the casting means and the hot-forming means or is a part of a hot-forming means. In either arrangement of the apparatus, conditioning of the cast metal is accomplished between the casting and the hot-forming of the cast metal and while the cast metal is at substantially hot-forming temperature. Thus, conditioning of the cast metal by the conditioning means may be either prior to hot-forming or the initial step in hot-forming. After a cast metal has been conditioned by the conditioning means, the cast metal may be hot-formed into a hot-formed product of substantially any shape by the hot-forming means without substantial cracking and splitting of the cast metal occuring.

This is because the destruction of the columnar dendritic structure provides a cast metal having a greatly increased tensile strength. The tensile strength attained is sufficient to prevent substantial cracking and splitting of the cast metal because of hot shortness or internal stresses and the cast metal is as suitable for hot-forming without cracking and splitting as a cast metal which has been homogenized. The invention is particularly significant as an invention in the art of producing a hot-formed product by the continuous casting and hot-forming of a cast metal since the required reduction of the cross-sectional area of the cast metal is easily accomplished at a rapid rate as the cast metal continuously passes between the casting means and the hot-forming means.

BRIEF DESCRIPTION OF THE DRAWING

These and other features and advantages of the invention will be more clearly understood from the following detailed description and the accompanying drawings in which the like characters of reference designate corresponding parts in all figures and in which:

FIG. 1 is a top plan view of apparatus embodying the present invention and which includes a conventional continuous casting machine and a conventional rolling mill as the casting means and the hot-forming means respectively;

FIG. 2 is an enlarged elevational view of the compressing rolls in the conditioning means of the apparatus shown in FIG. 1;

FIG. 3 is a diagrammatic drawing of the compressing rolls shown in FIG. 2 illustrating with velocity triangles the velocity relationships in the rolling grooves of the rolls;

FIG. 4 is a cross-sectional representation of the cast metal in a cast bar prior to conditioning for hot-forming in the apparatus of the present invention;

FIG. 5 is an enlarged view of a portion of the representation of the cast metal in the cast bar shown in FIG. 4;

FIG. 6 is a cross-sectional representation of the cast metal in the cast bar shown in FIG. 4 after conditioning for hot-forming in the apparatus of the present invention.

DESCRIPTION OF AN EMBODIMENT

The following detailed description discloses a specific embodiment of the invention but the invention is not limited to the details disclosed since it may be embodied in other equivalent forms.

Referring to FIG. 1, it will be seen that the apparatus chosen for the purpose of illustrating an embodiment of the present invention generally includes a casting means such as the casting machine 40, a hot-forming means such as the rolling mill 22, and a conditioning means such as the two-roll stand 47. The two-roll stand 47 includes a base 10, a left upright 11, a right upright 12, an upper roll 14 mounted on a shaft 15, and a lower roll 16 mounted on a shaft 18. The rolls 14 and 16 are rotatably positioned parallel to each other between the left upright 11 and the right upright 12 by the shafts 15 and 18, and the shaft 18 extends through the left upright 11 to a clutch 13 which serves to join the shaft 18 in known manner to the drive shaft 19 of a motor 20 mounted on a platform 17 adjacent the left upright 11.

The motor 20 drives the roll 16 through the shaft 18 and the shaft 15 is joined within the right upright 12 to the shaft 18 so that as the shaft 18 rotates in a particular rotational direction, the shaft 15 rotates in the opposite rotational direction and at the same rotational speed as the shaft 18. Thus, the motor 20 serves to rotate the rolls 14 and 16 in opposite directions at substantially identical rotational speeds.

The spacing between the rolls 14 and 16 is adjustable by rotation of a wheel 23 at the upper end of a shaft 27 extending from within the right upright 12. Positioned above the base 10 in the path of a cast bar 21 as it moves through the rolls 14 and 16 are a pair of guide rolls 38 and 39 rotatably carried by supports 45 attached to the base 10. The guide roll 38 is shaped to receive and support the cast bar 21 as it approaches the rolls 14 and 16 and the guide roll 39 is shaped to receive and support the cast bar 21 as it exits the rolls 14 and 16 to be fed to the rolling mill 22.

As is best seen in FIG. 2, each of the rolls 14 and 16 has a groove 30 having the shape of a semi-ellipse. Together the grooves 30 define an elliptical rolling channel 29 in which the cast bar 21 is compressed as it passes between the rolls 14 and 16. This rolling channel 29 serves to prevent excessive spreading of a cast bar 21 having a cross-sectional shape generally similar to that shown in FIG. 4 as it is compressed by the rolls 14 and 16 to produce a cross-sectional shape of the cast bar 21 generally similar to that shown in FIG. 6.

Moreover, as is best shown in the diagram of FIG. 3, the rolling channel 29 provides linear speed relationships or gradient in the cast bar 21 as the cast bar 21 passes between the rolls 14 and 16 which physically prevent significant cracking and splitting of the cast bar 21 because of abrupt changes in velocity within the cast bar 21 as it is being compressed. This is because the elliptical shape of the rolling channel 29 causes the rolls 14 and 16 to have different linear tangential velocities as they engage different portions of the cast bar 21, thereby establishing a linear velocity gradient thereacross. As indicated by the lengths of the arrows 32 and 34 in FIG. 3, that portion of each groove 30 nearest the axis of rotation of rolls 14 and 16 has the smallest tangential velocity and those portions of each groove 30 at its outer edges have the greatest tangential velocity.

It will be understood that those portions of each groove 30 between that portion indicated by an arrow 32 as having the smallest tangential velocity and that portion indicated by an arrow 34 as having the greatest tangential velocity will progressively increase in tangential velocity from the smallest tangential velocity to the largest tangential velocity. It will also be understood that this velocity relationship within the rolling channel 29 tends to force the outer edges of a cast bar 21 inwardly toward the center of the rolling channel 29 when the cast bar 21 is fed between the rolls 14 and 16. From the foregoing, it will be seen that the two-roll stand 47 provides a means for reducing the cross-sectional area of the cast bar 21 while at the same time physically preventing significant cracking or splitting of the cast bar 21 even though the metal in the cast bar 21 has not been homogenized.

It will now be understood that the two-roll stand 47 described above is generally conventional and that it is for this reason that other known details of its construction have not been described. It will also be understood that the casting machine 40 is of known type having a casting wheel 41 with a peripheral groove 41' and a belt 42 for closing a length of the peripheral groove 41' and that the rolling mill 22 is also of known type having a plurality of roll stands 22' driven by a motor 20'. Further, it will be understood that when a cast bar 21 is inserted between the rolls 14 and 16 from the left as viewed in FIG. 1, the rolls 14 and 16 reduce the cross-sectional area of the cast bar 21 and force the cast bar 21 to the right to be received by the rolling mill 22 in which the cast bar 21 is hot-formed by passing in sequence through the plurality of roll stands 22'.

The cross-section of the cast bar 21 after passing between the rolls 14 and 16 as shown in FIG. 6 is particularly well adapted for rolling or hot-forming in a rolling mill 22 or similar hot-forming apparatus into a rod or other hot-formed product. However, the primary purpose of the two-roll stand 47 in the invention is to provide a conditioning means for substantially reducing the cross-sectional area of the cast bar 21 with a single compression by an amount which is sufficiently great to substantially destroy the dendritic structure of the cast bar 21. This is because it is this particular amount of reduction in the cross-sectional area of the cast bar 21 which conditions the cast bar 21 for hot-forming. Thus, any apparatus arrangement suited to reducing the cross-sectional area of a cast bar 21 with a single compression to a degree sufficient to substantially destroy the dendritic structure within a cast bar 21 while physically preventing the cracking or splitting of the cast bar 21 may be used as a conditioning means in the apparatus of the invention.

It will now be seen that in the apparatus of the invention, a cast bar 21 is conditioned by compressing or squeezing the cast bar 21 in a conditioning means such as the two-roll stand 47 so as to reduce the cross-sectional area of the cast bar 21 with a single compression by that amount necessary to substantially destroy the dendritic structure in the cast bar 21 while at the same time physically preventing cracking or splitting of the cast bar 21 as it is compressed. Moreover, it will also be seen that the compressing or squeezing is accomplished between the casting machine 40 and the rolling mill 22 with the cast bar 21 at substantially hot-forming temperature. However, it should be understood that the first roll stand 22' in the rolling mill 22 may also serve as a means for conditioning the cast bar 21 for subsequent hot-forming by subsequent roll stands 22'.

In addition, it should be understood that regardless of the specific arrangement used to provide a conditioning means, the conditioning means serves to reduce the cross-sectional area of the cast bar 21 in a single compression to that extent necessary to substantially destroy the dendritic structure of the cast bar 21. The amount by which the cross-sectional area of the cast bar 21 must be reduced to destroy the dendritic structure of the metal in the cast bar 21 depends upon the particular metal from which the cast bar 21 is cast. Accordingly, it will be understood that in an embodiment of the invention such as that disclosed herein, the spacing between the rolls 14 and 16 is varied in accordance with the specific metal from which the cast bar 21 is cast.

For a cast bar 21 of copper which has internal stresses, which exhibits the characteristic of hot shortness to an undesirable degree, it has been found that a reduction in the cross-sectional area of the cast bar 21 with a single compression by at least approximately 36 percent will result in the destruction of the dendritic structure of the copper. The reduction is accomplished as the cast bar 21 passes between a casting means and a hot-forming means at a hot-forming temperature in the range of hot-forming temperatures for copper and the resulting cast bar 21 of copper, thus conditioned, may be subsequently hot-formed in the hot-forming means into substantially any desired hot-formed product without undesirable cracking or splitting.

The amount of reduction of the cross-sectional area of a cast bar 21 of a metal other than copper will be readily apparent to those skilled in the art or may be readily obtained empirically using known metallurgical techniques. The temperature at which the reduction is accomplished will be substantially the hot-forming temperature of the metal and this will also be readily apparent to those skilled in the art.

Regardless of the metal from which the cast bar 21 is cast, once the dendritic structure of the metal in the cast bar 21 is destroyed, the cast bar 21 is conditioned for hot-forming in a rolling mill 22 or other hot-forming means using conventional hot-forming techniques. The conditioning of a cast bar 21 in the invention is readily apparent by a comparison of FIG. 4 and FIG. 5 with FIG. 6. In FIG. 4 and FIG. 5, the cast bar 21 is illustrated as having columnar dendrites 24 and segregated alloying and other elements and compounds S trapped at the grain boundaries 25 of the dendrites 24.

FIG. 6 illustrates the cast bar 21 shown in FIG. 4 and FIG. 5 after it has been conditioned by a conditioning means. It will be seen from FIG. 6 that in the cast bar 21, the dendritic structure has been substantially completely destroyed. This eliminates the grain boundaries 25 at which the alloying and other elements and compounds indicated by the letter S in FIG. 5 were segregated and substantially increases the tensile strength of the metal in substantially the same manner as homogenizing the metal. As a result, the tensile strength of the metal in the cast bar 21 is now sufficiently great to resist cracking and splitting because of hot shortness, internal stresses, or both, during subsequent hot-forming.

From the foregoing description of the invention disclosed herein, it will now be understood that when a cast bar 21 having internal stresses or substantial amounts of elements and compounds causing hot shortness is conditioned for hot-forming by the destruction of the dendritic structure with a single compression of the cast bar 21 prior to hot-forming, the cast bar 21 may be subsequently hot-formed without cracking or splitting of the cast bar 21 even though the metal is not homogenized according to prior art procedures. Thus, the invention is ideally suited to continuously cast and hot-form metals since the arrangement of a casting means, a conditioning means, and a hot-forming means in the invention permits the continuous conditioning of a cast bar 21 as it passes continuously into a hot-forming means such as the rolling mill 22 from a casting means such as the casting machine 40.

It will of course be understood that the present invention is in no way limited to the particular device here presented by way of illustration, but many changes and modifications may be made, and the full use of equivalents resorted to without departing from the spirit or scope of the invention as defined in the appended claims.

We claim:

1. Apparatus for continuously casting and hot-forming a non-homogenized copper bar comprising:

casting means for continuously casting a cast bar of copper that is within the range of copper's hot-forming temperatures and which possesses a columnar dendritic structure, means remote from said casting means for initially substantially reducing the cross-sectional area of the cast bar of copper by a single compression and of a degree sufficient to substantially completely destroy the columnar dendritic structure in the cast bar of copper, said means for reducing comprising one roll stand having a substantially elliptical rolling channel for restricting lateral movement of the cast bar and for providing a linear velocity gradient thereacross which tend to substantially prevent cracking or splitting of the cast bar during said reduction, and hot-forming means for subsequently hot-forming the reduced cross-section cast copper bar while it is still within the range of copper's hot-forming temperatures, said cast bar temperatures having been established in said casting means.

2. The apparatus of claim 1 in which said means for reducing the cross-sectional area is constructed so as to reduce said cross-sectional area by at least 36%.

3. The apparatus of claim 2 in which said casting means is a casting wheel having a peripheral groove closed by a band.

4. The apparatus of claim 3 in which said hot-forming means is a rolling mill.

5. The apparatus of claim 1 in which said casting means is a casting wheel having a peripheral groove closed by a belt, and in which said hot-forming means is a plurality of roll stands positioned to receive and hot-form said reduced cross-section of copper.

6. Apparatus for continuously casting and hot-forming a non-homogenized copper bar comprising:

casting means for continuously casting a cast bar of copper that is within the range of hot-forming temperatures for copper and which possesses a columnar dendritic structure, hot-forming means disposed in spaced relation to said casting means along a path of travel of the cast bar of copper for subsequently hot-forming the cast copper bar while it is still within the range of hot-forming temperatures established in said casting means, means remote from said casting means disposed between said casting means and said hot-forming means along said path of travel for substantially completely destroying the columnar dendritic structure in the cast bar of copper in a single compression, and wherein said means for destroying the columnar dendritic structure includes means for substantially reducing the cross-sectional area of the cast bar of copper in a single roll stand having a substantially elliptical rolling channel for restricting lateral movement of the cast bar and for providing a linear velocity gradient thereacross which tend to substantially prevent cracking or splitting of the cast bar during said reduction in cross-sectional area.

7. Apparatus for continuously casting and hot-forming a non-homogenized copper bar comprising:

casting means for continuously casting a cast bar of copper that is within the range of copper's hot-forming temperatures and which posseses an as-cast grain structure, means remote from said casting means for initially substantially reducing the cross-sectional area of the cast bar of copper by at least 36% in a single compression, said compression being sufficient to substantially completely destroy the as-cast grain structure in the cast bar of copper, said means for reducing comprising one roll stand having a rolling channel including means for restricting lateral movement of the cast bar and for providing a linear velocity gradient thereacross which tend to substantially prevent cracking or splitting of the cast bar during said reduction, and hot-forming means for subsequently hot-forming the reduced cross-section cast copper bar while it is still within the range of copper's hot-forming temperatures, said cast bar temperatures having been established in said casting means.

8. The apparatus of claim 7 in which said casting means is a casting wheel having a peripheral groove closed by a band.

9. The apparatus of claim 7 in which said hot-forming means is a rolling mill.

10. The apparatus of claim 7 in which said casting means is a casting wheel having a peripheral groove closed by a belt, and in which said hot-forming means is a plurality of roll stands positioned to receive and hot-form said reduced cross-section of copper.

11. Apparatus for continuously casting and hot-forming a non-homogenized copper bar comprising:

casting means for continuously casting a cast bar of copper that is within the range of hot-forming temperatures for copper and which possesses an as-cast grain structure, hot-forming means disposed in spaced relation to said casting means along a path of travel of the cast bar of copper for subsequently hot-forming the cast copper bar while it is still within the range of hot-forming temperatures established in said casting means, means remote from said casting means disposed between said casting means and said hot-forming means along said path of travel for substantially completely destroying the as-cast grain structure in the cast bar of copper in a single compression, and wherein said means for destroying the as-cast grain structure includes means for reducing the cross-sectional area of the cast bar of copper by at least 36% in a single roll stand having a rolling channel having means for restricting lateral movement of the cast bar and for providing a linear velocity gradient thereacross which tend to substantially prevent cracking or splitting of the cast bar during said reduction in cross-sectional area.

12. Apparatus for continuously casting and hot-forming a non-homogenized copper bar comprising:

a continuous casting machine for casting molten copper into a continuous bar having an as-cast grain structure, a rolling mill having a plurality of individual roll stands for receiving the cast bar as it exits said continuous casting machine and for reducing the cross-sectional area of the bar in a series of sequential deformations, the first stand of said roling mill being arranged and adapted to reduce the cross-sectional area of the cast bar by at least 36% and thereby substantially completely destroy the as-cast grain structure of the cast bar, and wherein said first roll stand includes two rolls defining a rolling channel therebetween including means for restricting lateral movement of the cast bar and for providing a linear velocity gradient thereacross which tend to substantially prevent cracking or splitting of the cast bar during the reduction in cross-sectional area of the cast bar therein.

13. The apparatus of claim 12 wherein said rolling channel is substantially elliptical.

14. The apparatus of claim 12 wherein said casting machine is a wheel-belt type continuous casting machine.

* * * * *

UNITED STATES PATENT AND TRADEMARK OFFICE

CERTIFICATE OF CORRECTION

PATENT NO. : 4,129,170

DATED : Dec. 12, 1978

INVENTOR(S) : Daniel B. Cofer; George C. Ward; Dale D. Proctor

It is certified that error appears in the above-identified patent and that said Letters Patent are hereby corrected as shown below:

On the face of the Patent, Related U.S. Application Data should read as follows:

--Continuation of Ser. No. 323,471, Jan. 15, 1973, now abandoned, which is a continuation of Ser. No. 816,127, Apr. 14, 1969, abandoned, which is a continuation of Ser. No. 613,245, Feb. 1, 1967, abandoned, which is a division of Ser. No. 390,666, Aug. 19, 1964, Pat. No. 3,317,994.--

Column 1, CROSS-REFERENCE TO REALTED APPLICATION, lines 7-13, should read as follows:

--This application is a continuation of application Ser. No. 323,471, filed Jan. 15, 1973, now abandoned, which was a continuation of Ser. No. 816,127, filed Apr. 14, 1969, now abandoned, which was a continuation of Ser. No. 613,245, filed Feb. 1, 1967, now abandoned, which was a division of Ser. No. 390,666, filed Aug. 19, 1964, now U.S. Pat. No. 3,317,994.--

Column 8, line 42, change "roling" to --rolling--.

Signed and Sealed this

*Twelfth* Day of *June 1979*

[SEAL]

*Attest:*

RUTH C. MASON
*Attesting Officer*

DONALD W. BANNER
*Commissioner of Patents and Trademarks*